US005741965A

United States Patent [19]

Hernandez et al.

[11] Patent Number: 5,741,965

[45] Date of Patent: Apr. 21, 1998

[54] AIRCRAFT JET ENGINE TESTING TOOL

[76] Inventors: Carlos M. Hernandez, 1803 SW. 107th Ave., #2103, Miami, Fla. 33165; Charles Ramos, 14364 SW. 176th Ter., Miami, Fla. 33177

[21] Appl. No.: 758,483

[22] Filed: Nov. 29, 1996

[51] Int. Cl.[6] ..... G01M 15/00

[52] U.S. Cl. ..... 73/119 R; 73/456; 73/487; 73/583; 73/116

[58] Field of Search ..... 73/66, 456, 459, 73/460, 487, 583, 116, 119 R, 865.3

[56] References Cited

U.S. PATENT DOCUMENTS

| | | | |
|---|---|---|---|
| 4,078,864 | 3/1978 | Howell | 356/171 |
| 4,083,259 | 4/1978 | Seliger et al. | 74/191 |
| 4,116,052 | 9/1978 | Paluka | 73/117.3 |
| 4,372,517 | 2/1983 | Welch et al. | 248/267 |
| 4,604,896 | 8/1986 | Taschner et al. | 73/583 |
| 4,796,836 | 1/1989 | Buchelt | 244/23 R |
| 5,110,257 | 5/1992 | Hibner et al. | 415/119 |
| 5,162,659 | 11/1992 | Diamond et al. | 250/560 |
| 5,450,337 | 9/1995 | Chuan-Yuan et al. | 73/66 |
| 5,483,833 | 1/1996 | Dickens et al. | 73/583 |
| 5,537,861 | 7/1996 | Seitelman et al. | 73/66 |
| 5,615,574 | 4/1997 | Drechsler et al. | 73/487 |

*Primary Examiner*—George M. Dombroske
*Assistant Examiner*—Eric S. McCall
*Attorney, Agent, or Firm*—Malloy & Malloy, P.A.

[57] ABSTRACT

The present invention is directed towards an aircraft engine testing tool which facilitates the visual inspection of aircraft internal engine blades by permitting the automatic repositioning of the internal engine blades to an inspection orientation. The aircraft engine testing tool includes a power driver structured to selectively and in a precisely controlled manner turn internal engine and which includes a gear down assembly that produces substantial amounts of low speed torque, and a gear spline connected to the gear down assembly and structured to rotate at substantially low speeds in accordance with the low speed torque produced by the gear down assembly. A mounting plate secures the gear spline operatively within an aircraft engine gear socket such that the low speed rotation of the gear spline results in a corresponding rotation of a plurality of the internal engine gears of an aircraft engine's constant speed drive and therefore the internal engine blades. The aircraft engine testing tool further comprises a processor unit structured to receive a power supply and provide for regulated and controlled power and directional output to the power driver, from a remote location, thereby facilitating precise control of the direction and speed of the low speed rotation of the gear spline and therefore the internal engine blades.

30 Claims, 3 Drawing Sheets

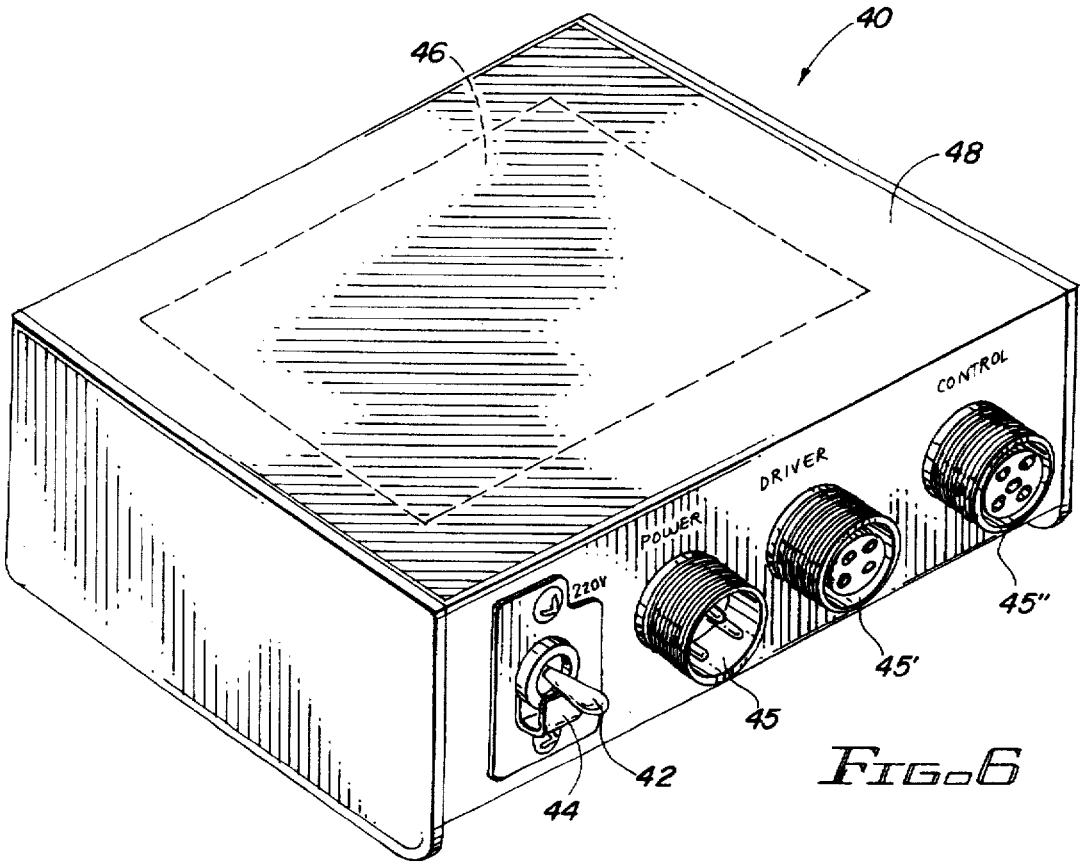
FIG. 6
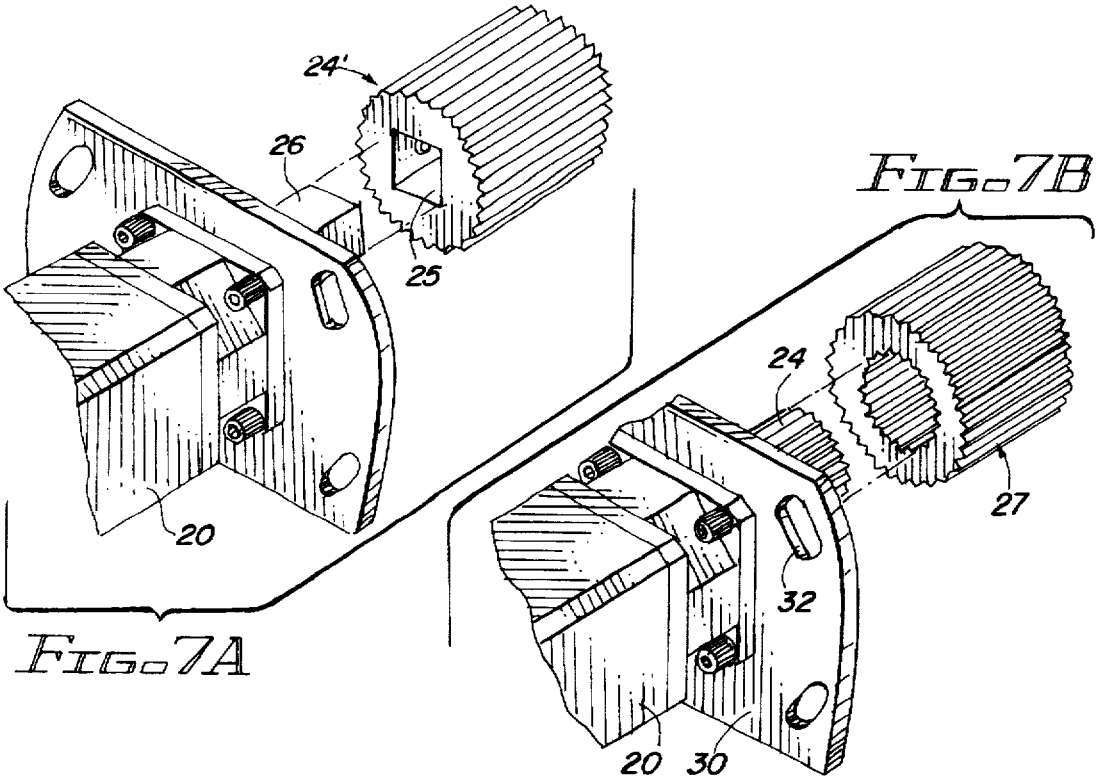
FIG. 7A
FIG. 7B

AIRCRAFT JET ENGINE TESTING TOOL

BACKGROUND OF THE INVENTION

1. Field of the Invention

The present invention relates to an aircraft engine testing tool that facilitates the inspection of the internal blades of an aircraft engine by providing for the automated rotational adjustment of the internal engine blades which permits an aircraft mechanic to adjust the position of the internal engine blades in an even-paced continuous motion, thereby avoiding abrupt stops, vibrations, or other unsteady movements, and avoiding the need to manually crank and adjust the position of the engine blades, while simultaneously continuing to visually inspect the blades.

2. Description of the Related Art

It will be appreciated by those familiar with maintenance of aircraft engines that routine inspection of an aircraft's internal engine blades is crucial. Through careful visual inspection of each of an aircraft's internal engine blades, an aircraft mechanic can ascertain the mechanical condition and air worthiness of an engine as it relates to the operation of the internal engine blades. For example, an aircraft mechanic may discover external debris, leaking fluids, or more significantly, the presence of cracks, scratches or chips in the blade, which could be potentially dangerous to the normal operation of the engine. In addition to being critical for proper maintenance of an aircraft, the visual inspection of an aircraft's internal engine blades is often critical for a proper appraisal of an aircraft's value. In particular, the expected life and operating efficiency of an engine is of major significance when evaluating an aircraft for potential purchase. As such, it is not uncommon for buyers, lenders, and appraisers of aircraft to request or individually perform a careful visual inspection of an aircraft's internal engine blades before making a purchase. Such an inspection reveals a great deal about an aircraft, and interested parties such as buyers and lenders can then properly evaluate an aircraft's condition and make allowances for defects, needed repairs, poor maintenance, excessive wear and tear, and the like.

Unfortunately, inspection of an aircraft's internal engine blades is an arduous, time-consuming, and expensive task. It is well known by those familiar with aircraft engines, that the internal blades cannot be easily accessed. Specifically, the internal engine blades of an aircraft are typically enclosed in an outer casing and surrounded by numerous other parts of the engine body which make direct visual inspection impossible. As such, it is not possible to directly view the entire portion of the internal blades of an aircraft engine. Accordingly, in order to achieve the necessary inspection, a borescope or fiber optic camera is typically utilized and inserted inside the aircraft engine to facilitate the viewing of the internal engine blades. However, even with the use of a borescope, it is only possible to view one or a select few of the aircraft engine blades at a time. It is therefore essential that the aircraft engine blades be rotated so as to permit the viewing of different blades.

It is that necessary rotation or movement of the aircraft's internal engine blades for inspection, however, that is the most time-consuming and laborious task associated with the inspection. In particular, because even the lowest idle speed of an aircraft engine provides for very rapid rotation of the engine blades, presently, movement of the internal engine blades requires an aircraft mechanic to manually adjust the location of the blades until a proper view can be obtained. Typically, the position of the aircraft's internal engine blades are manually adjusted by way of the engine gear socket disposed at the engines gearbox. Specifically, an aircraft mechanic typically connects a socket wrench at the engine gearbox and physically turns the wrench so as to actuate the internal engine gears and thereby adjust the location of the engine blades. Of course, given the often large number of gears which must be turned in order to translate sufficient rotational force from the smaller gears at the engine gearbox to the gears at the engine blades themselves, makes it quite a strenuous undertaking that is difficult to achieve, let alone at a continuous, even pace.

Further, because of the requirements of having a mechanic manually rotate the gears, it is presently necessary that inspection of an aircraft's internal engine blades be performed by at least two aircraft mechanics, working simultaneously. In particular, a first aircraft mechanic must manually adjust the location of the blades while a second aircraft mechanic looks into the borescope to view the condition of the aircraft internal engine blades and directs the first mechanic to move the location of the blades forward or backward. Those skilled in the art will appreciate that it is an extremely demanding task to manually move the aircraft engine blade a precise preset amount, and given the large number of blades it can be easy to lose track if one or more blades are missed. In fact, the aircraft mechanics doing the inspection will frequently experience a period of trial and error before a desired blade position can be obtained. Moreover, the aircraft mechanic actually viewing the internal blades must remain in constant communication with the mechanic responsible for manually adjusting the position of the blades. Naturally, this adds to the inefficiency and difficulty of precise viewing of the internal engine blades, as it is not uncommon for the aircraft mechanic responsible for manually rotating the internal engine blades to become fatigued and alternate positions with the other aircraft mechanic who will then take over the task of adjusting the blade positions. Such alternating inspection further practice raises problems of quality assurance and inspector accountability. Notwithstanding the quality assurance problems, however, it is readily apparent that this dual-function inspection by two aircraft mechanics of an aircraft engine's internal blades is a grossly inefficient, imprecise and expensive procedure.

Furthermore, the manual turning of the gears in the engine gear socket results in abrupt, jerky movements making it very difficult to properly view the blades for a thorough and meticulous inspection. It is often necessary to not only view the aircraft engine blades, but to document the inspection by recording the condition of the aircraft engine blades on video which will be shown to prospective purchasers or lenders. The value of such documentation, however, is highly dependent upon the quality and continuity of the filming. Excessive shaking and quick unsteady movements of the internal engine blades, as well as stopping of the film in between blade adjustments, departs substantially from the utility and integrity of the film as evidence of a thorough inspection since it raises the possibility that worn, cracked, or otherwise defective portions of the internal engine blades were not actually caught on the video. Moreover, in addition to the inherent difficulty in inspecting the internal engine blades of an aircraft due to the manual adjustment of an aircraft's internal engine blades, the erratic and jerky motions caused by such manual adjustment also subjects the engine's internal gears to unnecessary wear and tear and possible premature failure.

Accordingly, there is a need in the aircraft industry for a compact, durable and transportable device capable of efficiently and automatically adjusting the position of an aircraft's internal engine blades in an even-paced constant manner so as to facilitate the meticulous inspection of the blades. Moreover, there is a need for such a device wherein a single aircraft mechanic can inspect the condition of the aircraft's internal engine blades, while simultaneously adjusting their position.

SUMMARY OF INVENTION

The present invention is directed towards an aircraft engine testing tool which facilitates the visual inspection of an aircraft's internal engine blades by permitting the automatic re-positioning of the internal engine blades in an orientation where they can be easily viewed by an aircraft mechanic utilizing a borescope or similar inspection device. The present invention permits the blade position to be automatically and steadily adjusted with the push of a button and thereby eliminates the need to manually crank and adjust the position of the blades and consequently avoids abrupt stops, vibrations, and other unsteady movements of the internal engine blades during inspection.

The aircraft testing tool of the present invention includes a power driver structured to selectively and in a precisely controlled manner turn internal engine blades towards an inspection orientation. Specifically, the power driver includes a gear down assembly which is structured to produce substantial amounts of low speed torque. Connected to the gear down assembly is a gear spline which is structured to rotate at substantially low speeds in accordance with the low speed torque produced by the gear down assembly. The gear spline is structured to be drivingly disposed within an aircraft engine gear socket such that the low speed rotation of the gear spline results in a corresponding rotation of a plurality of internal engine gears of an aircraft engine's constant speed drive and therefore the internal engine blades themselves.

The power driver of the aircraft engine testing tool of the present invention further includes mounting means. The mounting means are structured to maintain the gear spline operatively within the aircraft engine gear socket. As such, the low speed torque produced by the gear down assembly is directed through the gear spline towards rotating the plurality of internal engine gears.

The aircraft engine testing tool of the present invention also comprises a processor unit. The processor unit includes power receiving means structured and disposed to receive power from a power source. Additionally, power supply means are provided and structured to supply power to the power driver for subsequent operation thereof. The power output supplied to the gear down assembly of the power driver, however, is precisely regulated by output regulating means that are further included with the processor unit. Furthermore, the processor unit includes control means. The control means are structured to permit the facilitated control of the power regulating operation, and a directional control operation, of the output regulating means in order to regulate and control the speed and direction of the low speed rotation of the gear spline, and henceforth the direction and speed of rotation of the internal engine blades.

It is an object of the present invention to provide an aircraft engine testing tool which facilitates the automated re-positioning of aircraft internal engine blades so that they may be easily and conveniently positioned for inspection.

A further object of the present invention is to provide an aircraft engine testing tool which permits a single aircraft mechanic to adjust the position of the aircraft internal engine blades while simultaneously visually inspecting the blades.

Another object of the present invention is to provide an aircraft engine testing tool which provides for the even-paced and steady movement of aircraft internal engine blades so that a user can meticulously scrutinize the blade without being impeded by undue vibrations, shaking, or other unsteady movement of the internal engine blades.

It is a further object of the present invention to provide an aircraft engine testing tool which is substantially powerful and has the capacity of supplying up to 1700 Lb/in of low speed torque.

It is also an object of the present invention to provide an aircraft engine testing tool which is powered by electric power and is adaptable so that it can operate on either a 110 volt or a 220 volt system.

Another object of the present invention is to provide an aircraft engine testing tool which includes a built in ramping feature so as to direct a controlled, gradual increase and decrease of the low speed torque produced by the gear down assembly, and thereby preserve the operating life of the assembly.

Still another object of the present invention is to provide an aircraft engine testing tool which eliminates the need to manually crank and position the blades of the aircraft engine in a position where they can be easily viewed.

Yet another object of the present invention is to provide an aircraft engine testing tool which substantially eliminates abrupt stops, vibrations, and other unsteady movements of the internal engine blades during inspection.

These and other objects, features and advantages of the present invention will become more readily apparent from the attached drawings and the detailed description of the preferred embodiments, which follows.

BRIEF DESCRIPTION OF THE DRAWINGS

For a fuller understanding of the nature of the present invention, reference should be had to the following detailed description taken in connection with the accompanying drawings in which:

FIG. 6 is an isolated perspective view of the processor unit of the aircraft engine testing tool of the present invention;

FIG. 7A is a perspective view illustrating the removable gear spline; and

FIG. 7B is a perspective view illustrating the gear spline adaptor.

Like reference numerals refer to like parts throughout the several views of the drawings.

DETAILED DESCRIPTION OF THE PREFERRED EMBODIMENT

Figure 1:
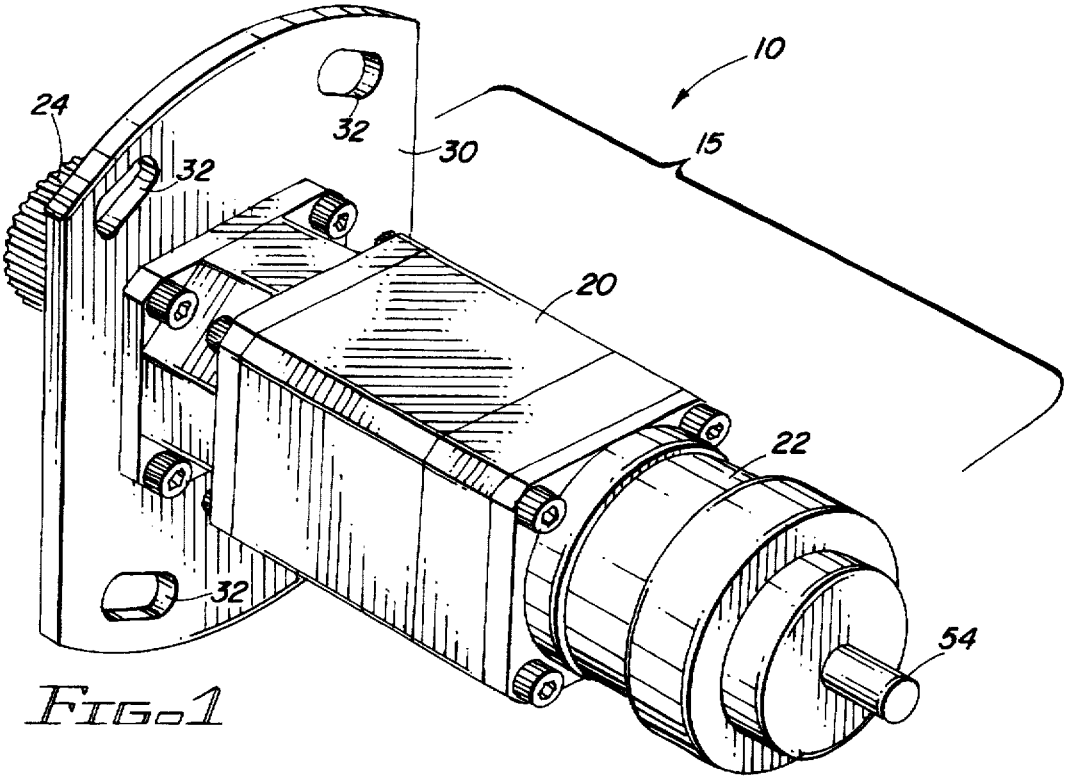
FIG. 1 is a perspective rear view of the power driver of the aircraft engine testing tool of the present invention.
Figure 2:
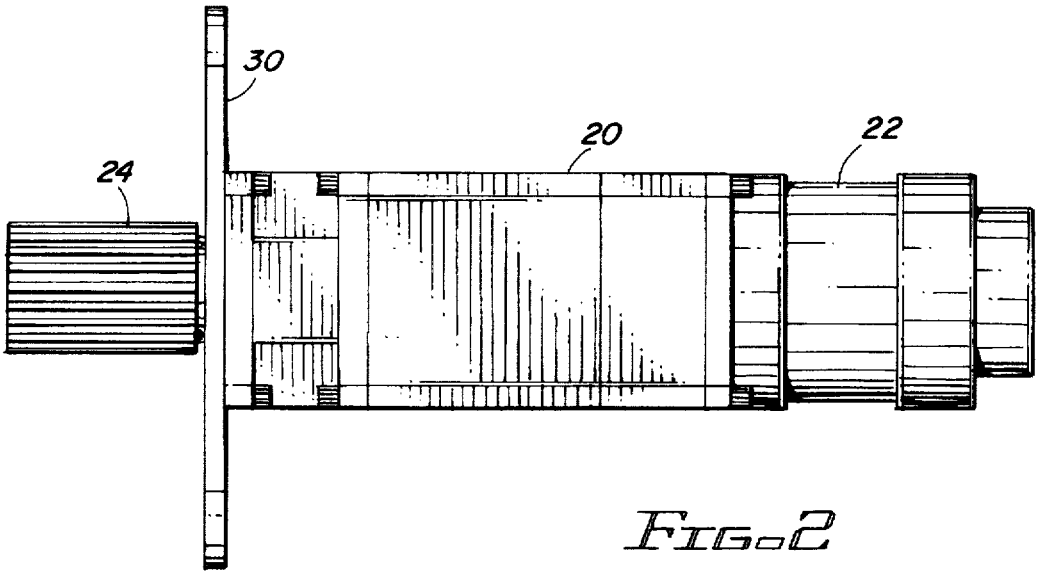
FIG. 2 is a side view of the power driver of the aircraft engine testing tool of the present invention.
Figure 3:
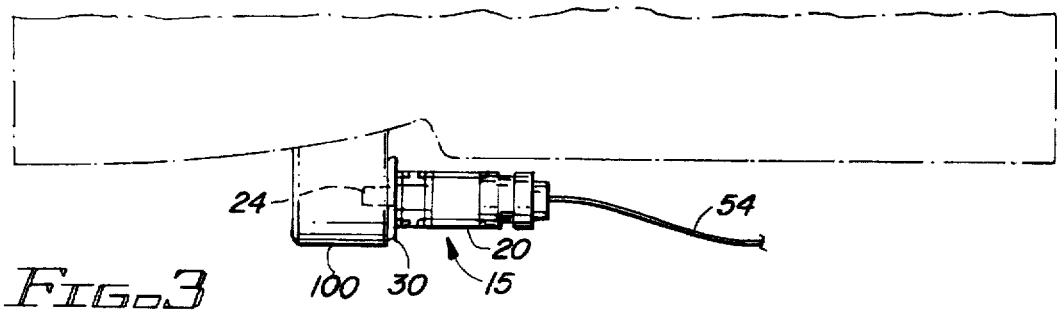
FIG. 3 is a side view of the power driver of the aircraft engine testing tool of the present invention in it's operative configuration secured to an aircraft engine gear socket.
Figure 4:
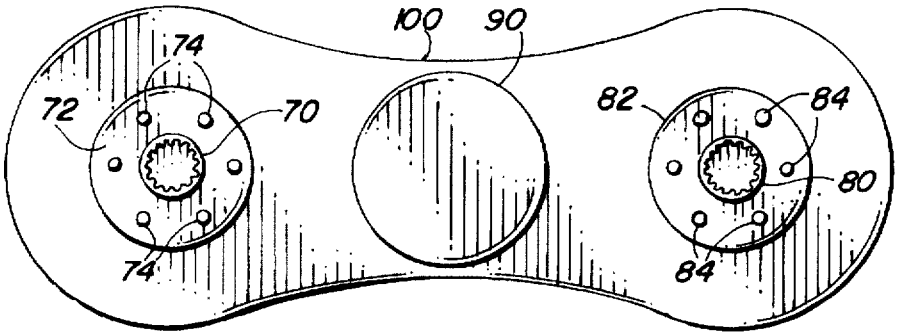
FIG. 4 is a perspective view of the aircraft engine gearbox showing the constant speed drive, starter pad, hydraulic pump pad, and the engine gear sockets.

Shown throughout the figures, the present invention is directed towards an aircraft engine testing tool, generally indicated as 10. The aircraft engine testing tool 10 is structured to permit the automatic adjustment of the internal engine blades of an aircraft to an orientation where they can be easily viewed by an aircraft mechanic utilizing a borescope or other inspection device. Moreover, the present invention eliminates the need to manually crank and adjust the position of the internal engine blades, and permits an effective and complete inspection to be accomplished by only a single aircraft mechanic.

Specifically, the aircraft engine testing tool 10 of the present invention includes a power driver 15 structured to selectively, and in a precisely controlled manner, turn the internal engine blades for purposes of inspection. In particular, the power driver 15 includes a gear down assembly 20 which provides substantial amounts of low speed torque. Although the gear down assembly 20 may be configured with various torque capacities, in the preferred embodiment the gear down assembly 20 will produce up to 1700 lbs/in of torque at substantially low speeds, thereby permitting slow, gradual rotation of internal engine gears and the blades. Furthermore, the gear down assembly 20 is provided with a stepping motor 22. While the stepping motor may be configured to move in only a single direction, preferably, the stepping motor is structured to provide for movement in both a forward and reverse direction. As a result, the aircraft internal engine blades may easily be rotated in either direction to allow for convenient and precise viewing. Along the same lines, the dual-direction capability of the stepping motor 22 makes it possible to quickly return to a previous blade position where needed.

Connected to the gear down assembly 20 and structured to rotate at substantially low speeds corresponding the low speed torque produced by the gear down assembly 20 is a gear spline 24. The gear spline 24 is structured such that the low speed rotation thereof results in a corresponding rotation of a plurality of internal engine gears of an aircraft's constant speed drive 90 and consequently the aircraft's internal engine blades. In the preferred embodiment, the gear spline 24 will be structured so that it can be operably connected to a JT3 or JT8 style aircraft engine. It will be appreciated by those skilled in the art, however, that the gear spline 24 may be adopted to fit a wide variety of other aircraft engine styles. For example, in an alternative embodiment illustrated in FIG. 7A, the gear spline 24' is removable so as to be interchangeable with a gear spline of a varying dimension and enable effective use and connection on a variety of different engine styles and sizes. In the preferred embodiment of this feature, the gear spline 24' includes a square or like cut socket 25 at one end structured to securely receive a corresponding insert 26. As such, adaptation for use with virtually any type aircraft engine may be achieved. Of course, it should be noted that a variety of removable interconnections, such as one including the male insert portion extending from the gear spline, may also be effectively utilized. Similarly, as illustrated in FIG. 7B, a gear spline adaptor 27 may be provided to facilitate use on a variety of engine designs. In this embodiment, the adaptor 27 fits over the standard gear spline 24 so as to modify the engagement profile to be achieved. Furthermore, if desired, the gear spline adaptor may include an insert or cut socket at an original fixed or removable gear spline, and/or a variety of socket adapters structured to facilitate a variation of the dimensions of the outermost gear spline to be ultimately utilized.

The gear spline 24 is preferably structured to be operably connected into an aircraft engine gear socket 70 disposed at an engine gearbox 100. In particular, most aircraft engines include a gearbox 100 that contains an engine's constant speed drive and a number of other articles. Moreover, the gearbox 100 typically includes both a starter pad 72 and a hydraulic pump pad 82, or some alternative access or test pad. In the case of the starter pad 72, it is structured to normally receive the engines starter control mounted thereon, and in driving communication with an engine gear socket 70. As such, removal of the starter control exposes the engine gear socket 70, making it available for driven connection with the gear spline 24 of the power drive 15. Similarly, the hydraulic pump pad 82, which is structured to normally receive a hydraulic pump therein, includes an engine gear socket 80 such that removal thereof results in exposure of the engine gear socket 80. Accordingly, gear spline 24 of the power drive 15 can be operatively connected into either the engine gear socket 70 disposed at a starter pad 72 or the engine gear socket 80 disposed at a hydraulic pump pad 82 or alternative access pad of the engine gearbox 100 depending upon the convenience and preference of the mechanics performing the inspection, and the type of aircraft engine being inspected. For example, some aircraft engines do not utilize a hydraulic pump but still include a hydraulic pump pad 82. It is therefore more convenient to connect the gear spline to the hydraulic pump pad 82 in such situations, as only a cap or cover plate must merely be removed to expose the engine gear socket 80. On the other hand, where an aircraft engine includes a hydraulic pump, it is typically easier to disconnect the engine starter control and connect the gear spline 24 to the starter pad 72 than it is to disconnect the hydraulic pump and consequently drain a quantity of hydraulic fluid in order to access the engine gear socket 80 vacated by the hydraulic pump. Accordingly, the engine testing tool 10 of the present invention can be effectively implemented when the engine is in its Bare Engine Configuration, with no accessories attached thereto, a QEC (Quick Engine Change) configuration wherein the engine is ready to go on an airplane for immediate use, or even while the engine is installed on an aircraft.

In order to ensure effective operation and interconnection between the gear spline 24 and the engine gear socket 70 or 80, the power driver 15 of the present invention further includes mount means. The mount means are specifically structured and disposed to operably secure the gear spline 24 within one of the aircraft engine gear sockets 70 or 80 such that the low speed torque produced by the gear down assembly 20 is directed through the gear spline 24 and towards rotating a plurality of internal engine gears and subsequently, the internal engine blades. In particular, given the great amount of torque required to rotate all of the gears and the internal engine blades, a torque applied at the gear spline will have a tendency to rotate the gear down assembly relative to the gears at the engine gear socket rather than the engine gears and therefore the internal engine blades relative to the gear down assembly as is necessary. As such, even though the mount means may include manual positioning and holding by a mechanic, it is preferred that more secure and affirmative mount means be employed. For example, although a number of different external mounting brackets, assemblies and/or adapters may be provided, in the preferred embodiment, the mounting means will include a mounting plate 30 with a series of apertures 32 disposed therein. The mounting plate 30 is structured to be secured directly to the gearbox 100 at either the starter pad 72, the hydraulic pump pad 82, or the alternative access pad which may be provided. In particular, both the starter pad 72 and the hydraulic pump pad 82 typically include a series of studs or bolts 74 at which the starter control or hydraulic pump are secured during normal operation of the aircraft engine. As such, when either is removed, those studs or bolts 74 are exposed and are available for secure fastening of the mounting plate 30. In this regard, the precisely positioned apertures 32 on the mounting plate 30 receive the studs 74 therethrough for secure fastening therein. A nut or like mating element will preferably be tightened on the stud 74 so as to maintain a secure, hands-free connection between the gear spline 24 and either of the aircraft engine gear sockets 70 or 80, and ensure that substantially all of the low speed torque produced by the gear down assembly 20 is directed towards rotating the gear spline 24 and the plurality of internal engine gears to which the gear spline 24 is connected. Moreover, if necessary, the mounting plate 30 may structured to be removable, and/or one or more adaptor plates may be provided and secured to the mounting plate 30 in order to facilitate mounting on a variety of engine types.

Figure 5:
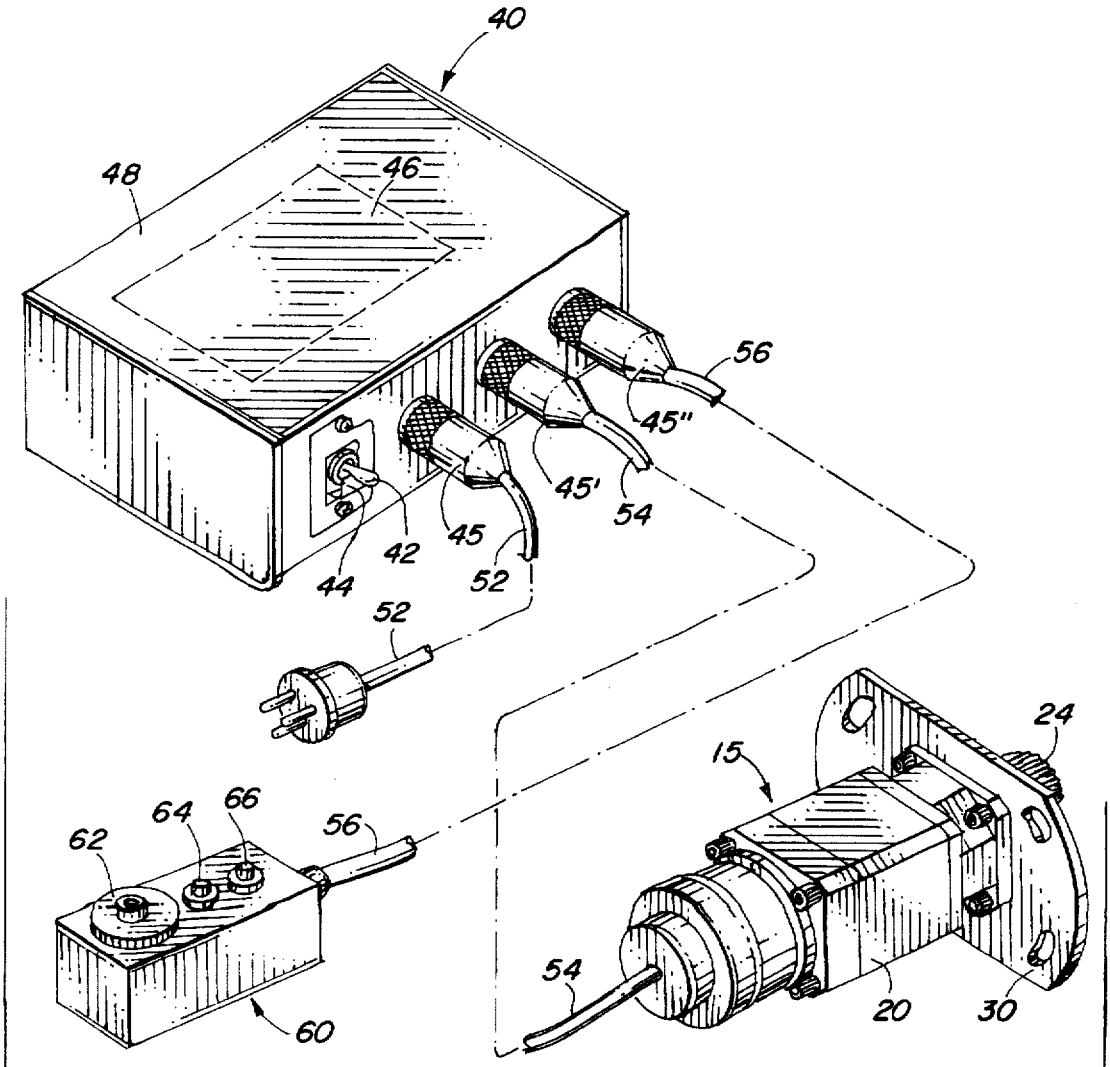
FIG. 5 is a perspective view of the aircraft engine testing tool of the present invention.

The aircraft engine testing tool 10 of the present invention further includes a processor unit 40, as best shown in FIGS. 5 and 6. The processor unit 40 includes power receiving means structured to receive power from a power source. Further, in the preferred embodiment, the power receiving means include an external power cord 52 connected between the power source and output regulating means. Moreover, the power receiving means are preferably structured to receive variable voltage power inputs from a conventional or specifically adapted power source, and is particularly oriented so as to receive power from both a 220 volt power source and a 110 volt source. Along these lines, the processor unit of the preferred embodiment of the aircraft engine testing tool 10 includes an input voltage selection switch 42. Preferably, the input voltage selection switch 42 includes a single toggle switch having three operating positions. In particular, the three position toggle switch is structured to be selectively moved between a 110 Volt receiving position, an off position, and a 220 volt receiving position. Moreover, so as to ensure safe operation at all times, the preferred embodiment of the present invention includes an adjustable position restrictor plate 44 positioned with the input voltage selection switch 42. Specifically, the adjustable position restrictor plate 44 includes an aperture through which the input voltage selection switch 42 protrudes, and is structured to be mounted to permit either movement of the input voltage selection switch 42 selectively between the 110 volt receiving position and the off position only, or movement of the input voltage selection switch 42 between a 220 volt receiving position and an off position. As such, once the restrictor plate 44 is properly set, inadvertent switching to accept the incorrect voltage input cannot be achieved.

As indicated, the processor unit 40 includes output regulating means. Specifically, the output regulating means are structured to regulate a power output to the gear down assembly 20 of the power driver 15. In particular, the gear down assembly 20 receives a power output by way of a power output cord 54 that is connected in power receiving communication with the output regulating means. As such, the output regulating means by providing more or less power and varying the output can control the speed and amount of rotation of the gear spline 24 very precisely. In the preferred embodiment, the output regulating means includes a potentiometer 46 for the power regulating purposes. Moreover, in the preferred multi-directional embodiment of the present invention, the output regulating means are structured to regulate a directional control and henceforth control the direction of rotation of the gear spline 24. It should be noted, however, that although not preferred, rotation in a single direction may be provided. Additionally, in the preferred embodiment, the processor unit 40, as part of the output regulating means, includes ramping means. The ramping means are structured and disposed to direct a controlled, gradual, ramped increase and decrease of the low speed torque produced by the gear down assembly 20. This gradual increase and decrease of the low speed torque prevents erratic movements and vibrations so as to allow careful and meticulous viewing of the aircraft internal engine blades. Moreover, the gradual increase and decrease of the low speed torque prevents excessive wear and tear on the internal engine gears of the aircraft engine, which may result if abrupt or erratic movement takes place. Also, such gradual increases and decreases during operation ensures a longer life to the gear down assembly 20 by ensuring that movement of the gears takes place in accord with the torque produced by the gear down assembly 20, thereby minimizing a risk of burn out. It is therefore seen that the even-paced movement of the aircraft internal engine blades facilitates accurate and reliable documentation of the internal blade inspection by way of a video recording, for example. Similarly, the absence of vibrations, abrupt stops, high power starts, or unsteady movements of the engine blades or breaks in the continuity of the video recording increases the reliability of the inspection and any video recording as evidence that portions of the internal engine blades were not excluded from filming, while preserving the functioning of the testing tool 10.

Preferably, the output regulating means of the processor unit 40 are structured to be effectively contained within a compact housing 48, best shown in FIG. 6. The compact housing 48 is structured to be substantially transportable, such as in a designated carry case, and provides durable containment to the processor unit. Preferably the compact housing is substantially strong and rigid to resist impacts and damage that may normally occur in a repair/testing environment. Moreover, the compact housing 48 preferably includes a completely sealed configuration so as to be fluid and dust impervious, and is configured of a material which acts as a heat sink during operation. In particular, due to the power regulation function of the output regulating means and compact nature of the housing 48, substantial amounts of heat are produced during operation. As such, the material composition of the compact housing 48 is preferably structured to dissipate that heat and thereby maintain proper operation.

As illustrated in FIG. 6, the input voltage selection switch 42 is preferably disposed in an exteriorly actuatable position on the compact housing 48. Additionally, the compact housing 48 includes a series of plugs to facilitate rapid, removable connection between the internal components of the processor unit and external components of the tool 10. Specifically, the compact housing 48 includes a power input plug 45 structured to receive the external power cord 52 in power receiving communication therewith. Similarly, the housing 48 includes a power output lug 45' to which the power output cord 54 is removably connected. It is seen, that the removable interconnection enables rapid installation, but compact storage of the entire testing tool 10 within a carry case from inspection location to inspection location.

Also removably connected at the housing 48, as part of the processor unit 40, are control means. The control means are structured and disposed to permit facilitated control of the output regulating means and to thereby regulate a direction and speed of the low speed rotation of the gear spline 24. In the preferred embodiment, the control means includes a compact, hand-held, remotely actuatable control unit 60 connected with the output regulating means. The control unit 60 is structured to be communicatively connected to the output regulating means by way of an elongate cord 56, which is removably connected at a control plug 45" of the housing 48, so as to permit facilitated actuation by a user while actually inspecting engine blades. The preferred embodiment of the remotely actuatable control unit 60 includes both a rotational speed control switch 62 and a pair of directional control switches 64 and 66. Naturally, the rotational speed control switch 62, which preferably includes a potentiometer, precisely controls the rate of rotation of the gear spline 24, and therefore the internal engine blades, while the directional control switches 64 and 66 control the rotation of the gear spline 24 and engine blades in opposite directions. The rotational speed switch 62 will preferably be configured as a thumb wheel, as shown in FIG. 5. As such, more controlled adjustment of the pace of rotation can be achieved. It will be appreciated by those skilled in the art, however, that a wide variety of other known types of switches may be utilized without departing from the present invention. Additionally, even though a single switch may be utilized, it is preferred that the pair of directional control switches 64 and 66 be utilized for a more precise, controlled inspection. Specifically, the directional control switches 64 and 66 are preferably push-button, momentary switches which must be actuated in order for rotating power to be supplied to the power driver 15. It is also noted that the control unit 60 may also be utilized as a foot pedal if hands free manipulation is required, and/or minor modifications can be made thereto for more convenient foot pedal adaptation and utilization.

Since many modifications, variations, and changes in detail can be made to the described preferred embodiment of the invention, it is intended that all matters in the foregoing description and shown in the accompanying drawings be interpreted as illustrative and within the scope and spirit of this invention, and not in a limiting sense. Thus, the scope of the invention should be determined by the appended claims and their legal equivalents.

Now that the invention has been described,

What is claimed is:

1. To be used to facilitate the internal inspection of an aircraft engine; an aircraft engine testing tool comprising:

(a) a power driver structured to selectively and in a precisely controlled manner turn internal engine blades into an inspection orientation, said power driver comprising:

a gear down assembly structured to produce substantial amounts of low speed torque, a gear spline connected with said gear down assembly and structured to rotate at substantially low speeds in accordance with said low speed torque produced by said gear down assembly, said gear spline being structured to be drivingly disposed within an aircraft engine gear socket such that said low speed rotation thereof results in corresponding rotation of a plurality of internal engine gears of an aircraft engine's constant speed drive and the engine blades thereof, and mount means structured and disposed to maintain said gear spline operatively within the aircraft engine gear socket, during said low speed rotation thereof, such that said low speed torque produced by said gear down assembly is directed through said gear spline towards rotating the plurality of internal engine gears;

(b) a processor unit, said processor unit comprising:

power receiving means structured and disposed to receive power from a power source, power supply means structured and disposed to supply power to said power driver, output regulating means structured and disposed to regulate a power output and directional control to said gear down assembly of said power driver, and control means structured and disposed to permit facilitated control of said output regulating means so as to regulate a direction and speed of said low speed rotation of said gear spline.

2. An aircraft engine testing tool as recited in claim 1 wherein said processor unit includes a compact housing structured to contain said output regulating means.

3. An aircraft engine testing tool as recited in claim 2 wherein said compact housing includes a substantially sealed, fluid and dust impervious configuration.

4. An aircraft engine testing tool as recited in claim 2 wherein said compact housing acts as a heat sink structured to absorb and dissipate a quantity of heat produced by said output regulating means during operation thereof.

5. An aircraft engine testing tool as recited in claim 2 wherein said power receiving means includes an external power cord connected between said power source and said output regulating means.

6. An aircraft engine testing tool as recited in claim 5 wherein said compact housing includes a power input plug structured to receive said external power cord in power receiving communication therewith.

7. An aircraft engine testing tool as recited in claim 1 wherein said power receiving means are structured to receive variable voltage power inputs.

8. An aircraft engine testing tool as recited in claim 1 wherein said power receiving means are structured to receive said power from both a 220 volt power source and a 110 volt power source.

9. An aircraft engine testing tool as recited in claim 8 wherein said processor unit further includes an input voltage selection switch.

10. An aircraft engine testing tool as recited in claim 9 wherein said input voltage selection switch includes a three position toggle switch structured to be moved between a 110 volt receiving position, an off position, and a 220 volt receiving position.

11. An aircraft engine testing tool as recited in claim 10 further including an adjustable position restrictor plate structured and disposed to permit movement of said input voltage selection switch selectively between only said 110 volt receiving position and said off position, or said 220 volt receiving position and said off position.

12. An aircraft engine testing tool as recited in claim 1 wherein said control means of said processor unit includes a remotely actuatable control unit connected with said output regulating means and including at least one directional control switch and a rotation speed control switch.

13. An aircraft engine testing tool as recited in claim 12 wherein said rotation speed control switch includes a potentiometer.

14. An aircraft engine testing tool as recited in claim 12 including two of said directional control switches, each being structured to direct rotation in an opposite direction.

15. An aircraft engine testing tool as recited in claim 14 wherein said directional control switches are momentary switches which must be actuated in order for rotating power to be supplied by said power supply means to said power driver.

16. An aircraft engine testing tool as recited in claim 12 wherein said remotely actuatable control unit is structured to be hand held.

17. An aircraft engine testing tool as recited in claim 16 wherein said remotely actuatable control unit is connected with said output regulating means by an elongate cord so as to permit facilitated actuation by a user while actually inspecting the internal engine blades.

18. An aircraft engine testing tool as recited in claim 12 wherein said remotely actuatable control unit includes a foot pedal.

19. An aircraft engine testing tool as recited in claim 1 wherein said gear down assembly includes a stepping motor structured to move in both a forward and a reverse direction.

20. An aircraft engine testing tool as recited in claim 1 further including ramping means structured and disposed to direct a controlled, gradual, ramped increase and decrease of said low speed torque produced by said gear down assembly.

21. An aircraft engine testing tool as recited in claim 1 wherein said gear down assembly is structured to produce up to approximately 1700 lbs of force.

22. An aircraft engine testing tool as recited in claim 1 wherein said gear spline is structured to be operatively connected within the aircraft engine gear socket of a JT8 style aircraft engine.

23. An aircraft engine testing tool as recited in claim 1 wherein said gear spline is structured to be operatively connected within the aircraft engine gear socket of a JT3 style aircraft engine.

24. An aircraft engine testing tool as recited in claim 1 wherein said gear spline is structured to be operatively connected into the aircraft engine gear socket disposed at a starter pad of an engine gearbox and structured to normally receive an engine starter control.

25. An aircraft engine testing tool as recited in claim 1 wherein said gear spline is structured to be operatively connected into the aircraft engine gear socket disposed at a starter pad of an engine gearbox and structured to normally receive an engine starter control, and the aircraft engine gear socket disposed at a hydraulic pump pad of the engine gearbox and structured to normally receive a hydraulic pump.

26. An aircraft engine testing tool as recited in claim 1 wherein said gear spline is structured to be operatively connected into the aircraft engine gear socket disposed at a test pad of an engine gearbox.

27. An aircraft engine testing tool as recited in claim 1 wherein said mount means of said power driver includes a mounting plate structured to be connected with a plurality of studs to which an engine component structured to normally be connected at the aircraft engine gear socket, is normally secured, thereby maintaining secure, hands free connection between said gear spline and the aircraft engine gear socket and ensuring that substantially all of said low speed torque produced by said gear down assembly is directed towards rotating said gear spline and the plurality of internal engine gears to which said gear spline is connected through the aircraft engine gear socket.

28. An aircraft engine testing tool as recited in claim 27 wherein said mounting plate is removable so as to facilitate connection between said gear spline and the aircraft engine gear socket of various engine types.

29. An aircraft engine testing tool as recited in claim 1 wherein said gear spline is removably connected with said gear down assembly so as to facilitate interchanging thereof with at least one modified gear spline structured to be drivingly disposed within said aircraft engine gear socket of varying engine types.

30. An aircraft engine testing tool as recited in claim 1 further including a gear spline adapter structured to be coupled with said gear spline so as to facilitate adaptation of said gear spline for effective connection with the aircraft engine gear socket of various engine types.

* * * * *